US006210062B1

(12) United States Patent
Kokubo

(10) Patent No.: US 6,210,062 B1
(45) Date of Patent: Apr. 3, 2001

(54) FACIAL CLEANSING PURPOSE FOAMING MATERIAL

(75) Inventor: Yoshiaki Kokubo, Kainan (JP)

(73) Assignee: Kokubo Industrial & Co., Wakayama (JP)

( * ) Notice: Subject to any disclaimer, the term of this patent is extended or adjusted under 35 U.S.C. 154(b) by 0 days.

(21) Appl. No.: 09/526,725

(22) Filed: Mar. 16, 2000

(30) Foreign Application Priority Data

Dec. 15, 1999 (JP) ..... 11-356221

(51) Int. Cl.[7] ..... A47K 7/02; B43K 8/10

(52) U.S. Cl. ..... 401/201; 401/8; 15/209.1; 134/6

(58) Field of Search ..... 401/7, 8, 201, 401/196, 207, 88; 134/6; 15/208, 209.1, 229.11, 229.13

(56) References Cited

U.S. PATENT DOCUMENTS

| | | | | |
|---|---|---|---|---|
| 3,812,849 | * | 5/1974 | Giunta | 15/209.1 |
| 3,959,841 | | 6/1976 | Horne . | |
| 4,457,640 | | 7/1984 | Anderson . | |
| 5,486,064 | | 1/1996 | Schulte . | |
| 5,857,794 | * | 1/1999 | Chien | 401/201 |
| 6,048,407 | * | 4/2000 | Schoch | 401/201 |

FOREIGN PATENT DOCUMENTS

| | | |
|---|---|---|
| 10-276928 | 10/1998 | (JP) . |
| 92/02169 | 2/1992 | (WO) . |
| 96/04836 | 2/1996 | (WO) . |

* cited by examiner

*Primary Examiner*—Gregory L. Huson
*Assistant Examiner*—Tuan Nguyen
(74) *Attorney, Agent, or Firm*—Wenderoth, Lind & Ponack, L.L.P.

(57) ABSTRACT

A facial cleansing purpose foaming device can produce creamy soapsuds containing a lot of small bubbles with ease and also can squeeze out the produced soapsuds with ease. The facial cleansing purpose foaming device includes a tubular body which is formed of a flexible material being formed into a net-like form from synthetic resin material or synthetic resin fibers to have air permeability and water permeability. The body includes a gripping portion fitted to one end thereof and an opening formed at the other end thereof, and is so structured that it can contain therein solid cleansing material inserted from the opening.

11 Claims, 9 Drawing Sheets

FACIAL CLEANSING PURPOSE FOAMING MATERIAL

BACKGROUND OF THE INVENTION

1. Field of the Invention

The present invention relates to a facial cleansing purpose foaming device that can produce soapsuds containing a mass of fine bubbles when one's make-up is taken off or the facial cleansing is done, using facial cleansing material, such as liquid deterget or solid soap.

2. Prior Art

Unclean substances, such as sebaceous membranes oxidized with age, horny cell layers matured into dirt, make-up stains, dust in the air, or bacteria, adhere to the facial skin and block pores in the facial skin. Failure of an adequate skin-care may cause a pimple with inflammation.

For prevention of development of the pimple and rough skin, it is necessary to remove unclean substances from the skin surface and constantly keep the skin surface clean. The basics of keeping the facial skin clean is to wash one's face or facial cleansing.

Sebum includes salt and urea contained in sweat, resident flora of skin, or contaminant in the atmosphere, and these substances are decomposed by ultraviolet rays and oxygen in the air or breed in the skin, to adversely affect the skin.

Cosmetic materials, such as powdered cosmetic material or oils and fats of the cosmetic material, remaining on the skin surface, particularly in the pores in the skin, are mixed with the decomposed sebum to adversely affect the skin. Washing one's face or facial cleansing is effective for removing those substances from the skin surface to keep the skin surface clean and it is the basis of facial treatment.

In general, when the facial cleansing is done for taking off one's makeup or the like, one takes up cleansing material, such as solid, liquid or powdered facial soap (detergent) and rubs it with one's hands to produce soapsuds and then applies the soapsuds onto one's face.

When the soapsuds are produced by rubbing the cleansing material with one's hands, not much air is let into the cleansing material. It takes a lot of time to produce the soapsuds, and also the soapsuds thus produced are in a paste-like form and have a small foam height. Accordingly, one is inclined to consume an increased quantity of cleansing material and, as a result, the soapsuds becomes an irritant for the skin to that extent, which may provide an opposite effect of accounting for the rough dry skin, rather than the cleansing effect.

To cope with this problem, a facial cleansing purpose foaming device formed of a fine-meshed, low-stretch, tubular net was proposed, as disclosed by, for example, Japanese Laid-open patent publication No. 10(1998)-276928, according to which the net is collected at its opposite ends and fixedly tightened with strings or cramps or by thermowelding or equivalent and an operating part is formed at one end thereof.

This type of facial cleansing purpose foaming device has following disadvantages, however. First, since the net is collected and tightened at the opposite ends with the cramps or by thermowelding and thus becomes stiff at the collected portions, when the soapsuds are squeezed out from the facial cleansing purpose foaming device by grasping one end of the foaming device with one hand and drawing the foaming material through the other hand, the stiffly collected portions become a hindrance.

Second, since the collected portions are rolled in between one's hands joining together for the foaming, it gives an uncomfortable touch to the user.

Third, since the tubular body of the net is closed at its opposite ends, when the net is used in combination with a solid face soap, for example, it is necessary for the soap to be applied to each side of the net and, accordingly, it takes a lot of trouble to produce soapsuds, and also the soap is easily slipped off when the facial cleansing purpose foaming device is handed off from one hand to the other hand.

SUMMARY OF THE INVENTION

In the light of the disadvantages mentioned above, the present invention has been made. It is the object of the present invention to provide a facial cleansing purpose foaming device that can produce creamy soapsuds containing a lot of small bubbles with ease, and which also can squeeze out the produced soapsuds with ease.

To accomplish the above-noted object, the present invention provides a novel facial cleansing purpose foaming device comprising a tubular body which is formed of a flexible material being formed into a net-like form from synthetic resin material or synthetic resin fibers to have air permeability and water permeability. The body comprises a gripping portion fitted to one end thereof and an opening formed at the other end thereof, and is structured so that it can contain therein solid cleaning material inserted from the opening. According to the present invention, when the facial cleansing purpose foaming device impregnated with cleaning material is interposed between both hands and then is rubbed therewith, a large quantity of soapsuds can be produced. Thereafter, when the gripping portion is grasped with one hand and the body containing the soapsuds is drawn through the other hand, the creamy soapsuds inhaling lots of air can be squeezed out easily from the unrestrained opening, without any hindrance from the stiffly collected portion formed by solvent welding and the like, as in the prior art. Also, different from the prior art, since the body of the facial cleansing purpose foaming device to be rubbed is opened at one end so that no stiffly collected portion is formed thereat, it provides a comfortable touch to the user without any uncomfortable touch to the user.

It is preferable that the gripping portion is provided with a suspending/drawing ring. The arrangement of the ring in the gripping portion can provide the advantages of allowing an easier drawing of the body through the hand; of making the device hard to lose or drop; and of facilitating the drip of water so that the facial cleansing purpose foaming device can be dried quickly to maintain hygiene.

In addition, it is preferable that the body is doubled by folding back the material forming the body at the opening. With this arrangement, the folding portion also has adequate flexibility, so that for example the solid soap can easily be inserted and removed from the opening. Also, there is provided the advantage that when the solid soap and something similar is inserted in the body, the soapsuds can readily be produced from each side of the body, without handing off the body from one hand to the other hand, as in the prior art.

DETAILED DESCRIPTION OF THE INVETION

With reference to the accompanying drawings, the embodiments of the facial cleansing purpose foaming device according to the invention will be described.

Figure 1:
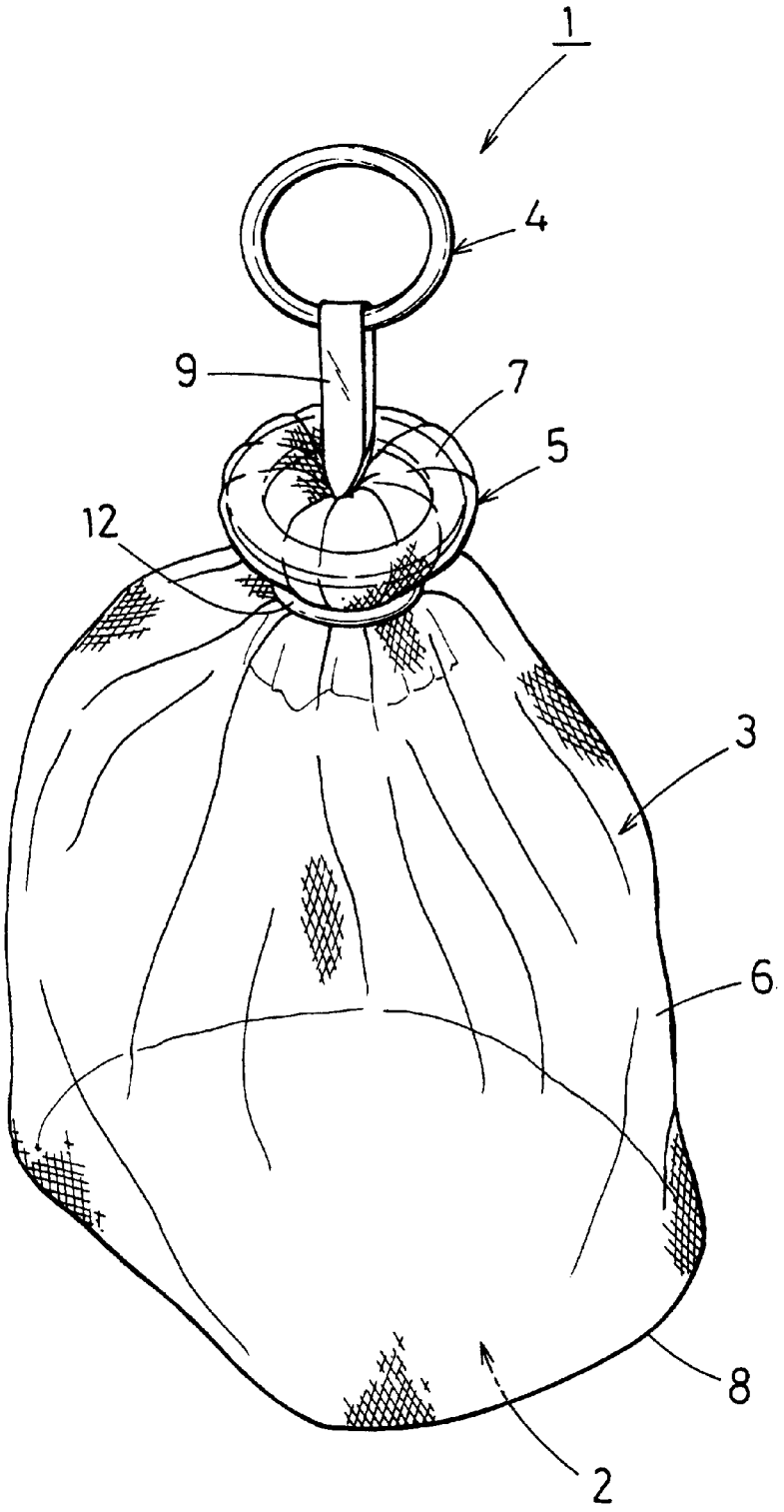
FIG. 1 is a perspective view of the entirety of a facial cleansing purpose foaming device according to the present invention.

Referring to FIG. 1, there is shown a perspective view of the entirety of a facial cleansing purpose foaming device according to the present invention. In FIG. 1, reference numeral 1 designates the entirety of the facial cleansing purpose foaming device.

The facial cleansing purpose foaming device 1 comprises a tubular body 3 having an unrestrained opening 2 at its lower (first) end and a gripping portion 5 having a suspending/drawing ring 4 at an upper (second) end of the body 3.

Figure 2:
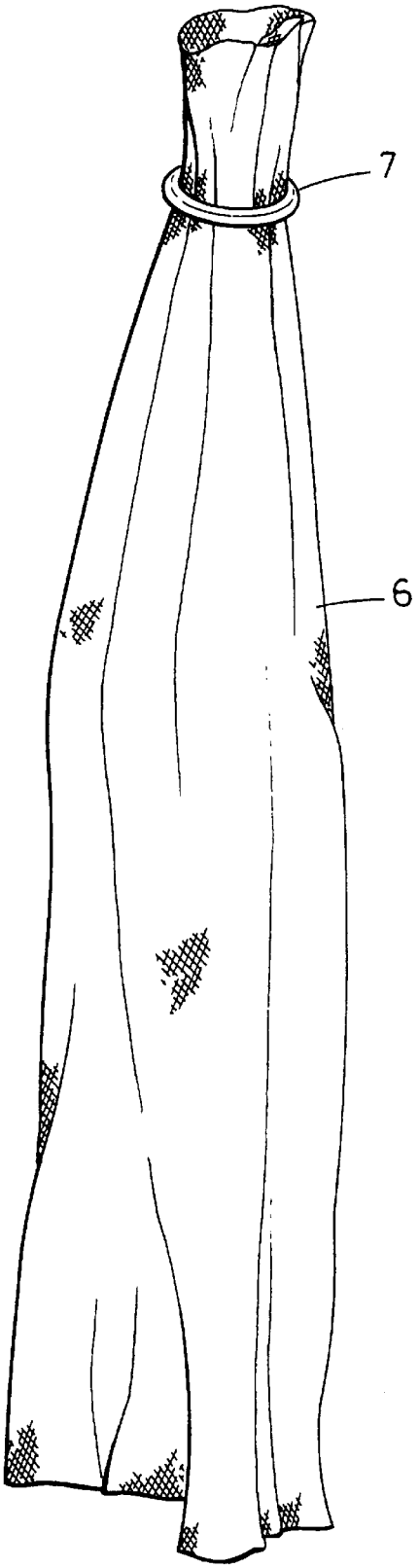
FIG. 2 is a perspective view showing a process step of the facial cleansing purpose foaming device according to the present invention.

The process steps for making the facial cleansing purpose foaming device 1 will be described in the following. First, a ring-shaped core 7 is fitted onto an upper end portion of net material 6 which is formed into a tubular form from an integrally molded plastic net made from a raw material, such as polyethylene, as shown in FIG. 2.

Figure 3:
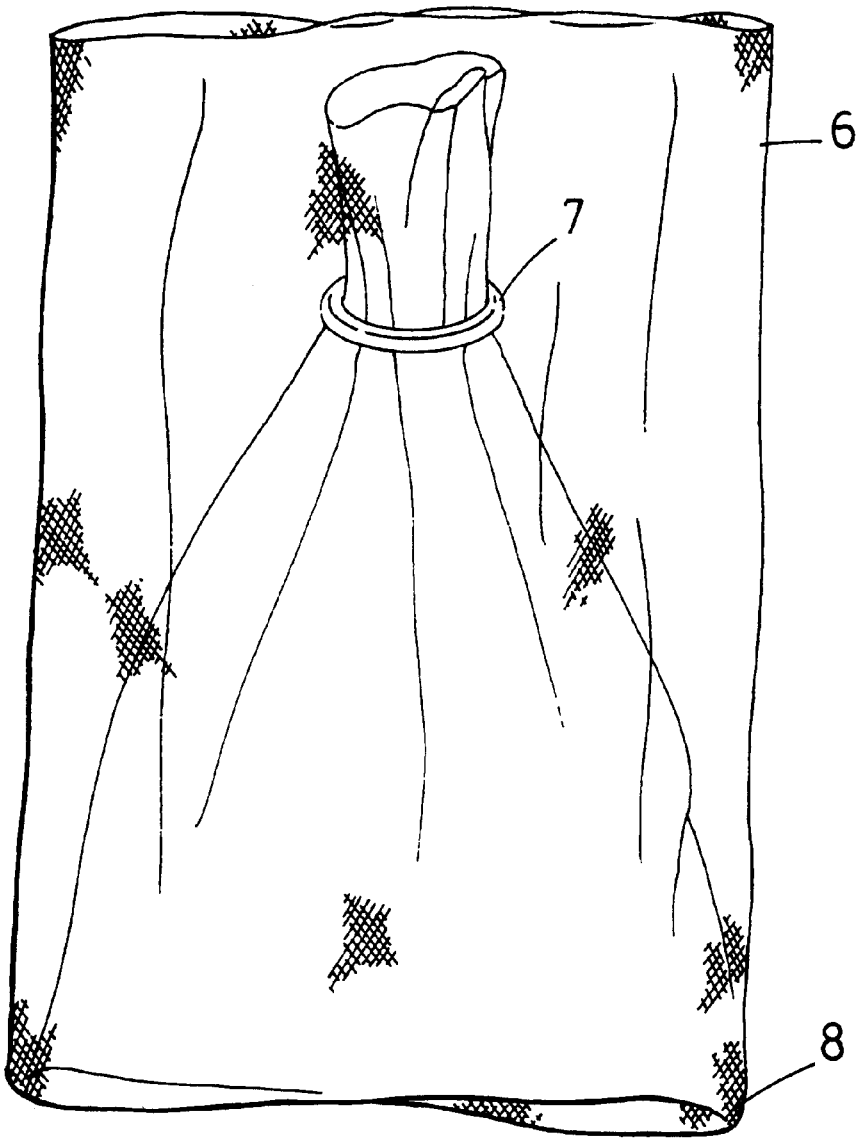
FIG. 3 is a front view showing a process step of the facial cleansing purpose foaming device according to the present invention.
Figure 4:
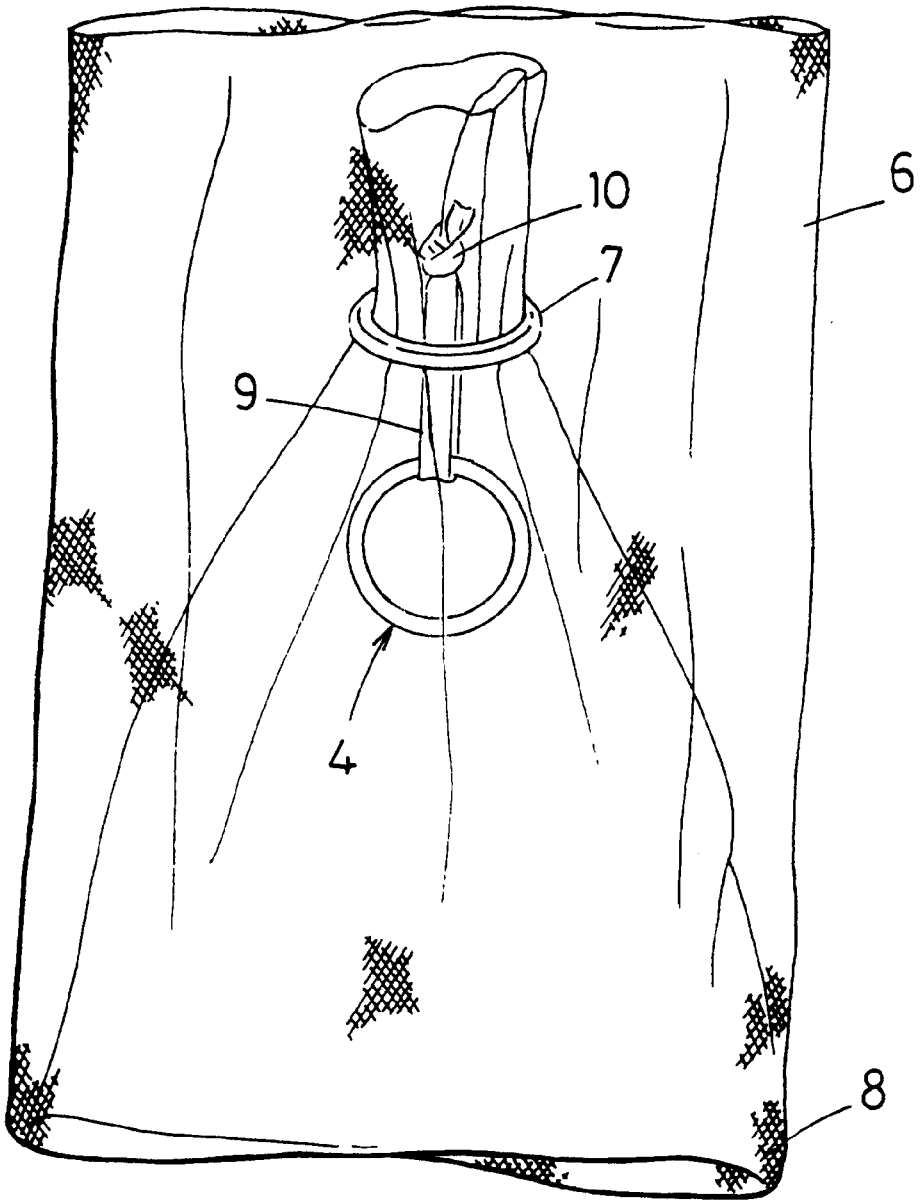
FIG. 4 is a front view showing a process step of the facial cleansing purpose foaming device according to the present invention.

Then, a lower half of the tubular net material 6 is folded back to the outside at a lengthwise midpoint thereof so that the ring-shaped core 7 is located inside the folded portion 20 of the tubular net material 6, as shown in FIG. 3. The folding part 8 forms the opening 2 when reversed, as mentioned later. In this state, a connecting string 9 for the suspending/drawing ring 4 is inserted in the ring 4. The string 9 and ring 4 are then inserted through the opening 2 so that a stopping knot 10 made by tying an end portion of the connecting string 9 is positioned at a higher level than the ring-shaped core 7, as shown in FIG. 4.

Figure 5:
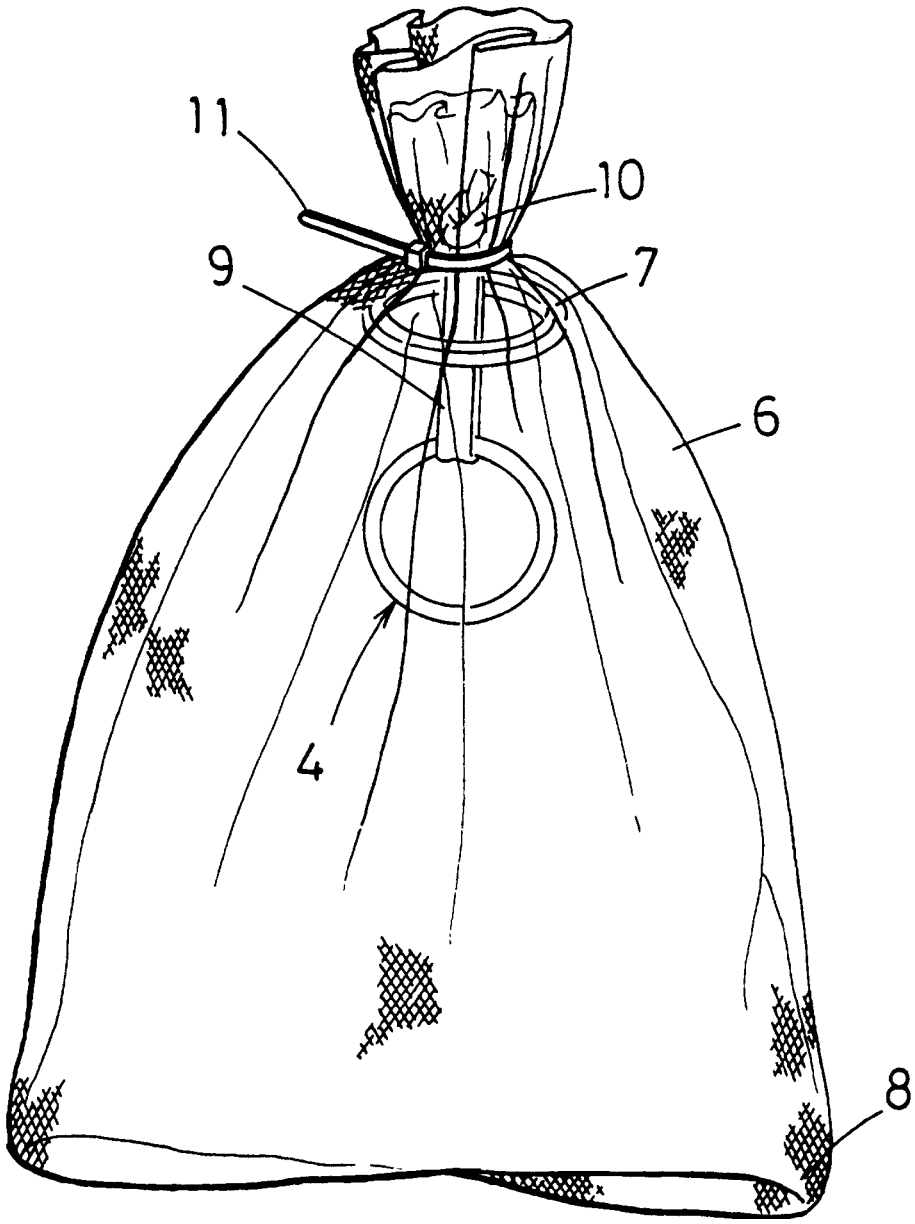
FIG. 5 is a front view showing a process step of the facial cleansing purpose foaming device according to the present invention.
Figure 6:
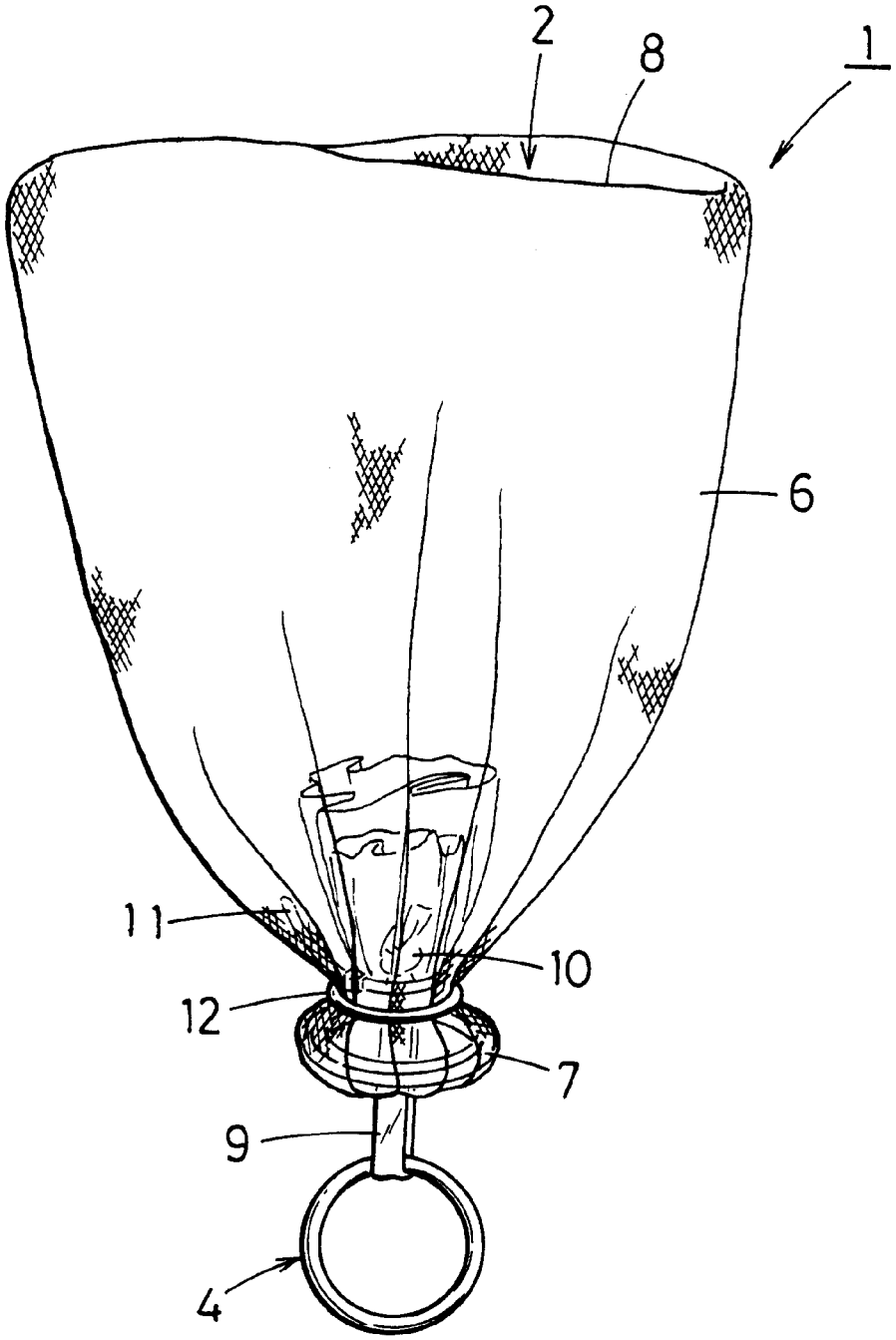
FIG. 6 is a front view showing a process step of the facial cleansing purpose foaming device according to the present invention.

Thereafter, a portion of the folded tubular net material 6 extending between the core 7 and the stopping knot 10 is tied firmly from outside the folded portion 2 at a position close to the end with a fixing band 11 (See FIG. 5). Then, the suspending/drawing ring 4 is pulled and the tubular net material 6 is reversed. Thereafter, a shape retaining ring 12 smaller in diameter than the ring-shaped core 7 is inserted from the opening 2 side and is fitted at a position close to the core 7, whereby the facial cleansing purpose foaming device 1 is completed (FIG. 6). Thus, as shown in FIG. 1 and FIG. 6, the opening 2 at the first end of the tubular body has no restraining element, such as a cord, a band or a tie, holding the opening 2 together.

Next, a typical example of how to use the facial cleansing purpose foaming device 1 thus produced will be described below.

Figure 7:
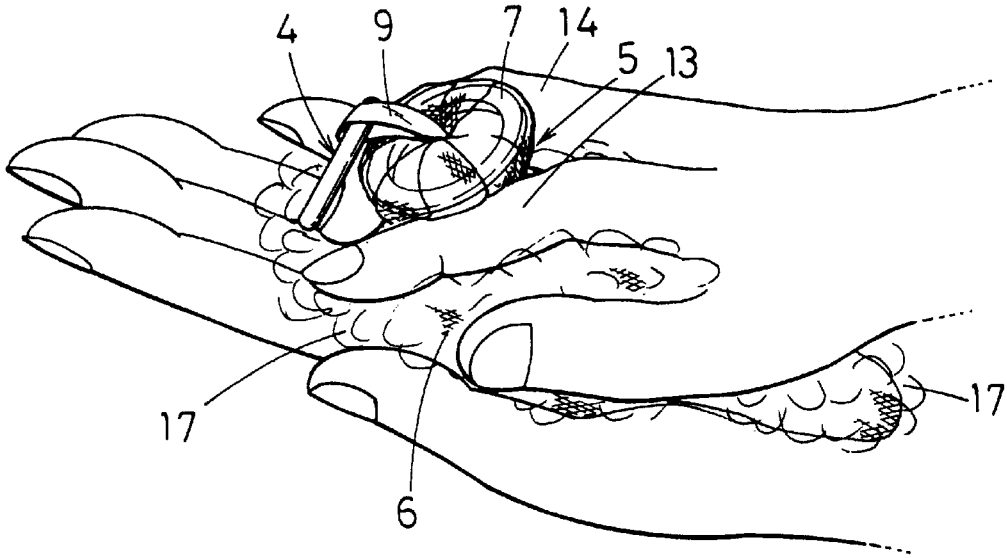
FIG. 7 is a perspective view of the facial cleansing purpose foaming device according to the present invention which is in the use state.

The facial cleansing purpose foaming device 1 impregnated with for example liquid facial cleansing material is put in the state in which the shape retaining ring 12 of small diameter is held in sandwich relation between the first finger (index finger) 13 and the second finger 14 of the right hand. Then, in a state in which the body 3 of the device 1 is interposed between the palms of both hands, the hands are rubbed to produce soapsuds, as shown in FIG. 7.

In this stage, a large quantity of air is allowed to enter the body 3 through the meshes of the plastic net material 6 from between the hands, and as such can allow the facial cleansing material to be foamed easily and quickly to thereby produce creamy soapsuds.

Figure 8:
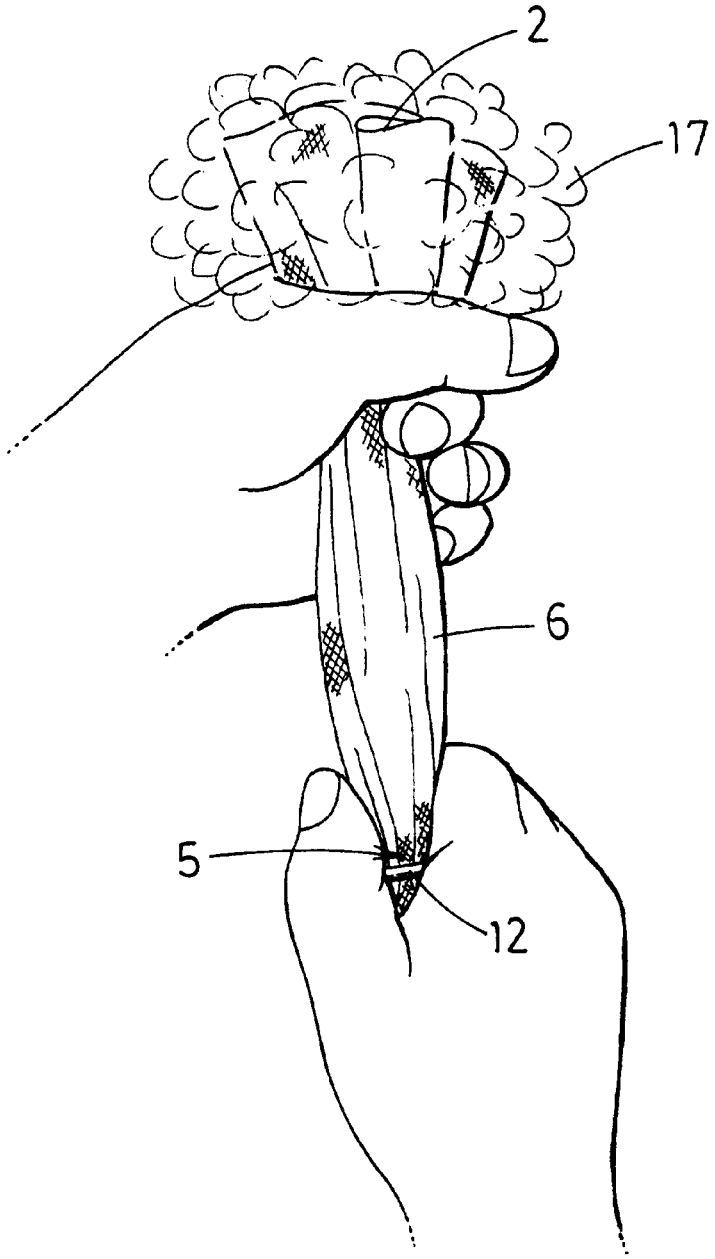
FIG. 8 is a perspective view of the facial cleansing purpose foaming device according to the present invention which is in the use state.

After the creamy soapsuds are produced from the facial cleansing material, the gripping portion 5 is grasped with one hand and the netted body 3 is drawn through the other hand, as shown in FIG. 8. The soapsuds produced from the facial cleansing material 17 can be squeezed out easily by this simple action through unrestrained opening 2.

In this stage, the body 3, which is designed to have the opening 2 formed by simply folding back the plastic net material 6, can be allowed to be drawn through the hand from one end to the other, so that the soapsuds are easily squeezed out from one end to the other of the body 3.

After use, the facial cleansing purpose foaming device 1 is washed without using soap and then suspended from a hook (not shown) by the suspending/drawing ring 4. This can facilitate the drip of water so that the device 1 can be dried quickly to maintain hygiene.

In the above-illustrated embodiment, the body 3 is formed by the net material 6 which is formed into a tubular form from an integrally molded plastic net made from raw material of polyethylene. Needless to say, the net may be formed from synthetic resin fibers or non-woven fabric or the like.

Figure 9:
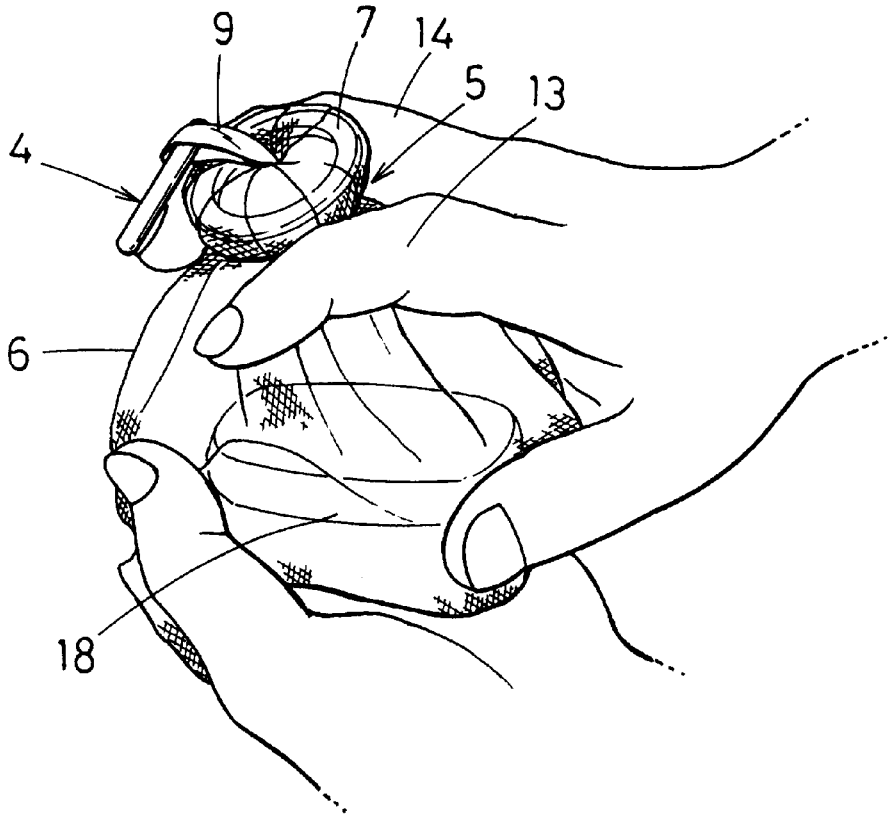
FIG. 9 is a perspective view showing another example of how the facial cleansing purpose foaming device according to the present invention is used.

In place of the liquid facial cleansing material used in the above-illustrated embodiment, powdered or granular facial cleansing material or solid facial cleansing material may, of course, be used in combination with the device. In the case where the solid facial cleansing material is used, the solid facial cleansing material 18 is inserted in the body 3 from the opening 2 and the left and right hands are rubbed in a state in which the body 3 is interposed therebetween, as shown in FIG. 9. This can produce the result that the soapsuds can be produced from the entire surface around the body 3 at the same time.

Further, in the above-illustrated embodiment, the body 3 is doubled by folding back the net material 6 at a lengthwise midpoint thereof. Needless to say, the net material 6 may also be formed as having a single thickness (i.e., not folded).

In addition, while in the above-illustrated embodiment, the suspending/drawing ring 4 is arranged at the upper end portion of the gripping portion 5, the suspending/drawing ring 4 may be omitted.

While the preferred embodiment of the invention has been described, it is to be understood that various changes and modifications may be made in the invention without departing from the sprit of the present invention. The scope of the invention, therefore, is to be determined solely by the following claims.

What is claimed is:

1. A foaming device comprising:

a tubular body having a first end and a second end, said tubular body comprising a flexible netting material formed of one of synthetic resin and synthetic fibers so as to be permeable to air and water;

an unrestrained opening formed in said first end of said tubular body for allowing cleansing material to be inserted inside said tubular body and foam to be removed from said tubular body; and a gripping portion formed at said second end of said tubular body.

2. The device of claim 1, further comprising a suspending ring connected to said gripping portion.

3. The device of claim 2, wherein said suspending ring is connected to said gripping portion by a connecting string.

4. The device of claim 2, wherein said tubular body has a first layer and a second layer formed by folding a single piece of said flexible netting material at said first end so as to form a fold at said first end.

5. The device of claim 1, wherein said gripping portion includes a core formed of a solid ring.

6. The device of claim 5, further comprising a suspending ring connected to said gripping portion by a connecting string.

7. The device of claim 6, wherein a first end of said connecting string is attached to said suspending ring and a second end of said connecting string has a knot therein, said gripping portion further including a fixing band arranged around said flexible netting material and located between said solid ring and said knot.

8. The device of claim 1, wherein said tubular body has a first layer and a second layer formed by folding a single piece of said flexible netting material at said first end so as to form a fold at said first end.

9. The device of claim 8, wherein said gripping portion includes a core formed of a solid ring.

10. The device of claim 9, further comprising a suspending ring connected to said gripping portion by a connecting string.

11. The device of claim 10, wherein a first end of said connecting string is attached to said suspending ring and a second end of said connecting string has a knot therein, said gripping portion further including a fixing band arranged around said flexible netting material and located between said solid ring and said knot.

* * * * *